US006431936B1

(12) United States Patent
Kiribuchi

(10) Patent No.: US 6,431,936 B1
(45) Date of Patent: Aug. 13, 2002

(54) BUILDING TOY

(75) Inventor: Chizuko Kiribuchi, Tokyo (JP)

(73) Assignee: People Co., Ltd., Tokyo (JP)

( * ) Notice: Subject to any disclaimer, the term of this patent is extended or adjusted under 35 U.S.C. 154(b) by 0 days.

(21) Appl. No.: 09/561,214

(22) Filed: Apr. 28, 2000

(51) Int. Cl.[7] ..... A63H 33/04
(52) U.S. Cl. ..... 446/92; 446/129
(58) Field of Search ..... 446/92, 129–139; 434/168; 273/155, 157

(56) References Cited

U.S. PATENT DOCUMENTS

| | | | | | |
|---|---|---|---|---|---|
| 2,690,626 | A | * | 10/1954 | Gay et al. | 446/137 |
| 3,196,579 | A | * | 7/1965 | Lepper | 446/92 |
| 3,584,410 | A | * | 6/1971 | Lalonde | 446/129 |
| 4,459,438 | A | * | 7/1984 | Kaiser | 446/465 |
| 4,462,596 | A | * | 7/1984 | Yamamoto | 446/137 |
| 4,822,283 | A | * | 4/1989 | Roberts | 434/168 |
| 5,651,715 | A | * | 7/1997 | Shedelbower | 446/137 |
| 6,024,626 | A | * | 2/2000 | Mendelsohn | 446/92 |
| 6,062,937 | A | * | 5/2000 | Kikuchi | 446/92 |
| 6,116,979 | A | * | 9/2000 | Weber | 446/92 |

FOREIGN PATENT DOCUMENTS

| | | | | |
|---|---|---|---|---|
| CA | 688911 | * | 6/1964 | 446/92 |
| DE | 976588 | * | 11/1964 | 446/92 |
| FR | 1976940 | * | 11/1954 | 446/92 |
| FR | 1355044 | * | 2/1964 | 446/92 |
| GB | 397533 | * | 8/1933 | 446/92 |

* cited by examiner

*Primary Examiner*—Derris H. Banks
*Assistant Examiner*—Urszula M. Cegielnik
(74) *Attorney, Agent, or Firm*—Swidler Berlin Shereff Friedman, LLP

(57) ABSTRACT

It is an object of the present invention to provide an invention comprising the connective means for connecting the blocks in which at least two or more permanent magnets are arranged on each side of said blocks in a manner such that a magnetic polarity thereof is opposite to neighboring magnets, and the invention that can easily be built into the solid from the developed plane so as to produce the educational effect by appealing to the eye by constructing said permanent magnets in a biaxially anisotropic fashion whereby each other's edge faces or surfaces are attracted.

Furthermore, it is another object of the present invention to provide a building toy that enables a preschool child user to cause a plurality of blocks to be attracted and built an arbitrary track on which a running toy runs as he likes so as to produce an effect on an intellectual training and learning by forming a track portion on each surface of a plurality of blocks capable of building, and constructing said blocks in a manner such that each other's edge faces thereof are connected by being attracted.

4 Claims, 7 Drawing Sheets

BUILDING TOY

TECHNICAL FIELD OF THE INVENTION

The present invention relates to a building toy comprising a plurality of blocks capable of building which are used to explain the features of the figure in learning so as to produce an educational effect.

In a conventional learning of arithmetic or the like, it is known that a board of a certain shape is caused to be attracted to a steel blackboard by magnetic force so as to explain the quantity or figure.

However, the board is so heavy because it is made of wood, which causes a problem that the board slips off the steel blackboard and gets broken because an attraction force thereof is too weak to stand the weight of the board itself, accordingly the board has been improved and there exists a hard synthetic resin sponge body, wherein a side of attraction force is provided only on the back surface thereof, and therefore it is not suitable for causing each other's edge faces to be attracted.

Furthermore, in learning of the figure, as the learning advances from the plane figure to the solid figure, it becomes more important particularly for the learning child to understand the relations between the solid figure and the developed plane figure.

However, there is no teaching tool which is suitable for use in building the solid directly from the developed plane, and what is desired to be invented in these days when the graphic representation in learning is increasing is a simple teaching tool.

The present invention has been made in view of the problems inherent in prior art, and it is an object of the present invention to provide an invention comprising the connective means for connecting the blocks in which at least two or more permanent magnets are arranged on each side of said blocks in a manner such that a magnetic polarity thereof is opposite to neighboring magnets, and the invention that can easily be built into the solid from the developed plane so as to produce the educational effect by appealing to the eye by constructing said permanent magnets in a biaxially anisotropic fashion whereby each other's edge faces or surfaces are attracted.

Furthermore, it is another object of the present invention to provide a building toy that enables a preschool child user to cause a plurality of blocks to be attracted and built an arbitrary track on which a running toy runs as he likes so as to produce an effect on an intellectual training and learning by forming a track portion on each surface of a plurality of blocks capable of building, and constructing said blocks in a manner such that each other's edge faces thereof are connected by being attracted.

As a conventional track building toy, a toy is known which is provided with a male connecting portion and a female connecting portion in a joint portion of the building rails, wherein said connecting portions are connected by causing them to be fitted to each other so as to change the length of the track as a user likes.

However, this conventional example is made of hard synthetic resin, which causes a problem that said male and female connecting portions are connected so tightly that particularly the male connecting portion out of the joint portion is likely to be broken when the preschool child user tries to take the connected rails apart.

Therefore, the present invention has been made in view of the problems inherent in prior art and provides a building toy, wherein a plurality of blocks can be attracted so as to build the arbitrary track on which the running toy runs and take it apart as the user likes by constructing each block in a manner such that the edge faces thereof are connected by being attracted to each other.

SUMMARY OF THE INVENTION

It is an object of the present invention to provide an invention comprising the connective means for connecting the blocks in which at least two or more permanent magnets are arranged on each side of said blocks in a manner such that a magnetic polarity thereof is opposite to neighboring magnets, and the invention that can easily be built into the solid from the developed plane so as to produce the educational effect by appealing to the eye by constructing said permanent magnets in a biaxially anisotropic fashion whereby each other's edge faces or surfaces are attracted.

Furthermore, it is another object of the present invention to provide a building toy that enables a preschool child user to cause a plurality of blocks to be attracted and built an arbitrary track on which a running toy runs as he likes so as to produce an effect on an intellectual training and learning by forming a track portion on each surface of a plurality of blocks capable of building, and constructing said blocks in a manner such that each other's edge faces thereof are connected by being attracted.

DESCRIPTION OF THE PREFERRED EMBODIMENTS

Figure 1:
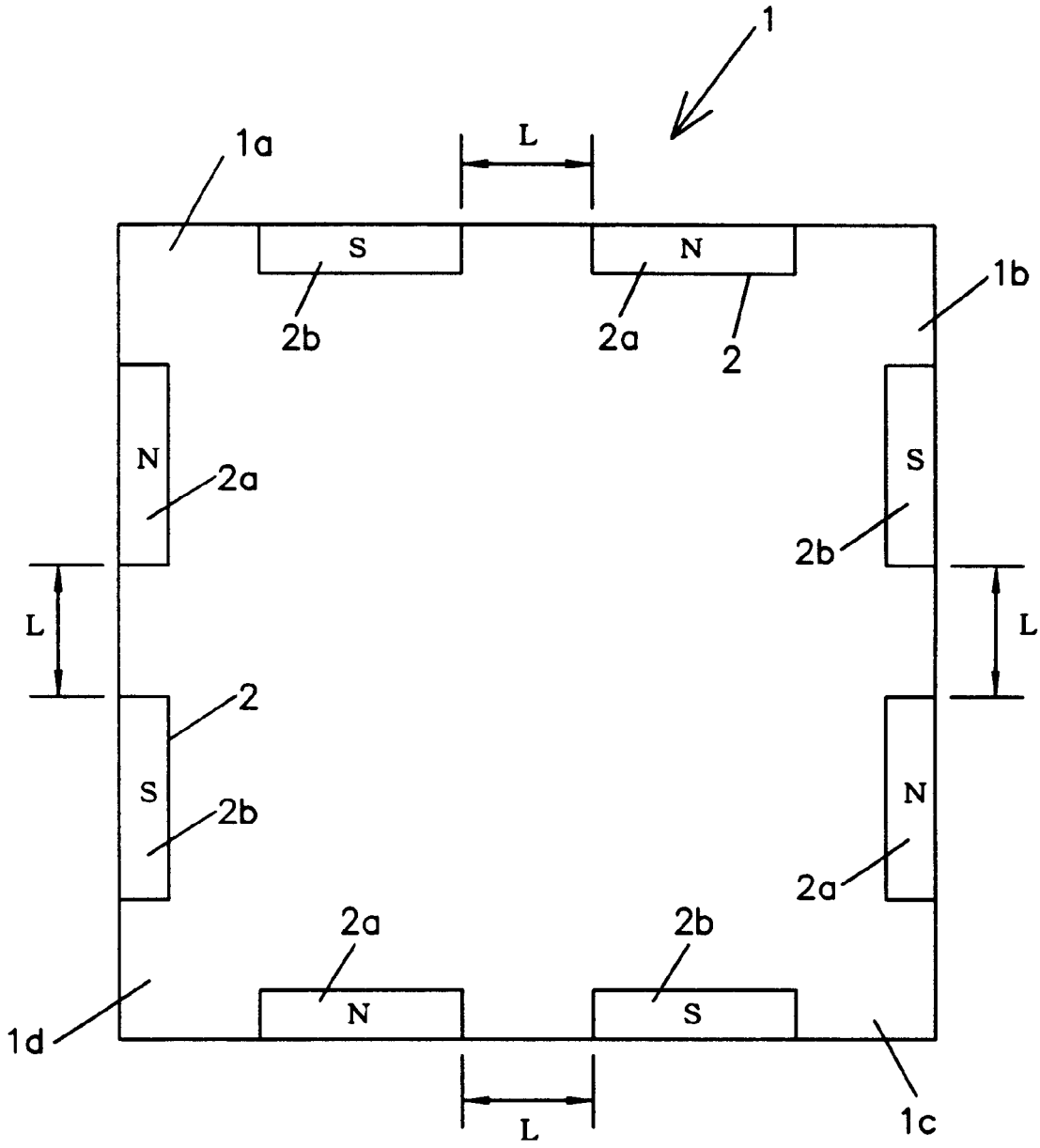
FIG. 1 is a plan view of a block showing one embodiment of the present invention.

Referring to the drawings, embodiments of the present invention will be described in detail below.

FIG. 1 is a plan view of a block showing one embodiment of the present invention. A block 1 is a square board having a certain thickness, wherein a number of permanent magnets 2 are housed on four sides thereof in a manner such that a certain interval L is maintained. As shown in FIG. 1, the permanent magnets 2 are arranged in a manner such that two permanent magnets are housed on each side of the square board 1, 1*a*,1*b*,1*c* and 1*d*, in a manner such that a certain intervals L is maintained. In addition, three or more permanent magnets may be provided so as to increase a magnetic force between the blocks. In this case, each permanent magnet is so arranged that the magnetic polarity thereof is opposite to neighboring magnets. In other words, a magnet 2*a* of the N pole and a magnet 2*b* of the S pole are alternatively disposed on each side.

Figure 2:
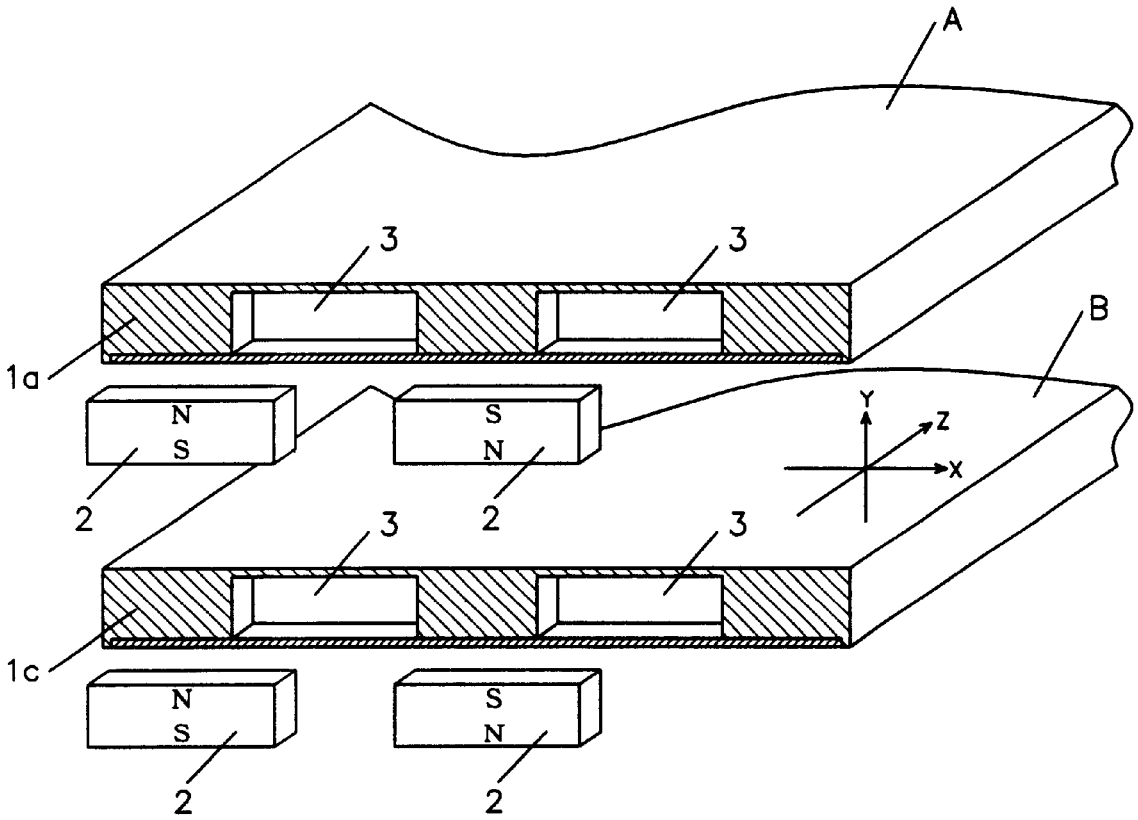
FIG. 2 is a perspective view, partly in section, showing the relations between positions of permanent magnets for use in the present invention.

Next, FIG. 2 is a perspective view, partly in section, showing the relations between positions of the permanent magnets for use in the present invention. As shown in FIG. 2, two recessed portions 3 are provided on each side of the block A and block B, respectively, wherein slightly small permanent magnet is housed in each recessed portion. Each magnet is arranged in a manner such that anisotropy thereof is effected in a direction vertical to the horizontal plane of the block 1. That is, as shown in FIG. 2, each permanent magnet is constructed in a manner such that it has the anisotropy primarily in the vertical direction (in the direction of the arrow Y) and secondly in the lateral direction (in the direction of the arrow X), while the magnet is constructed in a manner such that the magnetic property is not effected in the direction of the arrow Z. Therefore, the permanent magnet 2 does not need to be a perfect single-magnetic domain in structure, so that a biaxially anisotropic magnet is suitable which is magnetized primarily in the vertical direction and secondly in the horizontal direction. Needless to say, a material of the magnet is not limited, and all kinds of magnets such as Alnico, rare earth cobalt or the like are applied to said permanent magnet.

Consequently, the block A constructed as described above and the block B constructed in the same manner as the block A are designed to be attached at the sides 1*a* and 1*c*, corresponding to said respective blocks, respectively, and besides, the blocks A and B are rotated through 360 degrees so as to function as a hinge. Furthermore, reversing the direction of one block out of two, the blocks can be stacked one on top of the other by causing them to be attracted to each other. In addition, each block is not limited to a flat board but is adapted to various shapes such as square, triangle, isosceles triangle and pentagon or the like.

Figure 3:
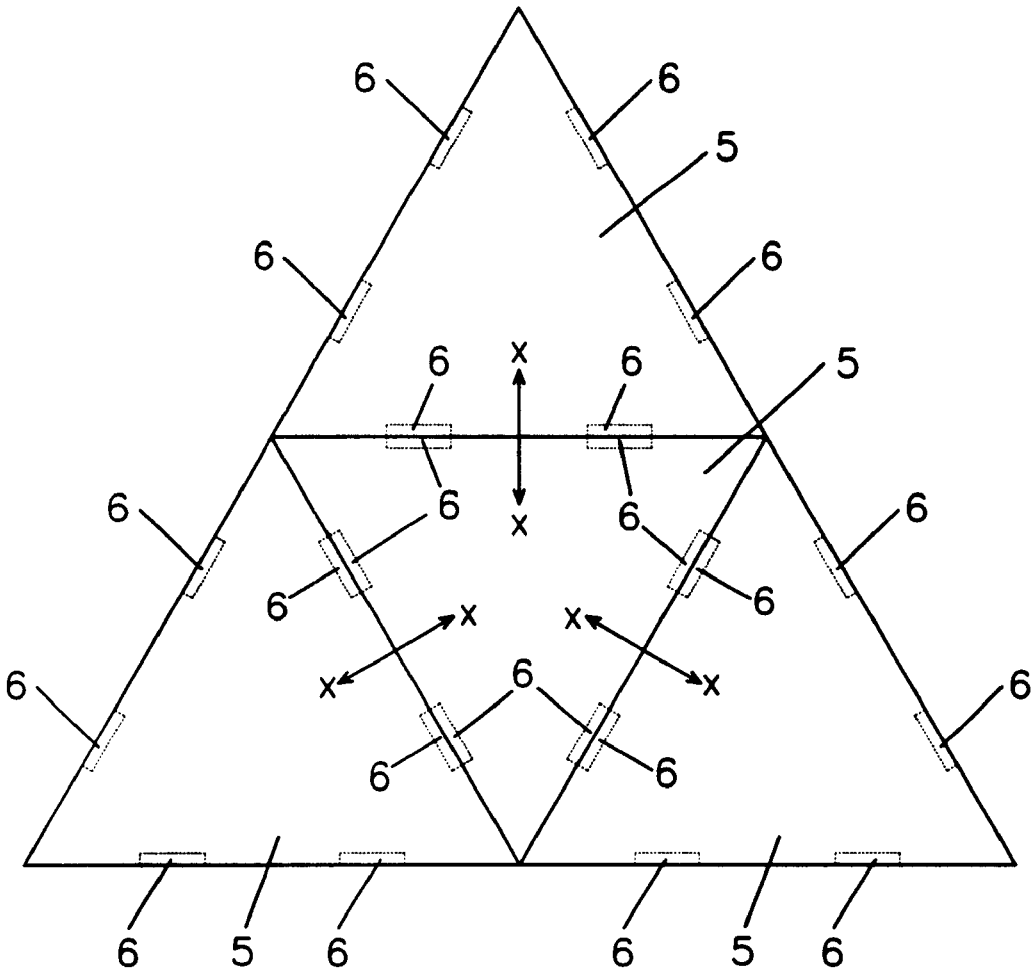
FIG. 3 is a plan view showing a pre-built state of a plurality of blocks for use in the present invention.
Figure 4:
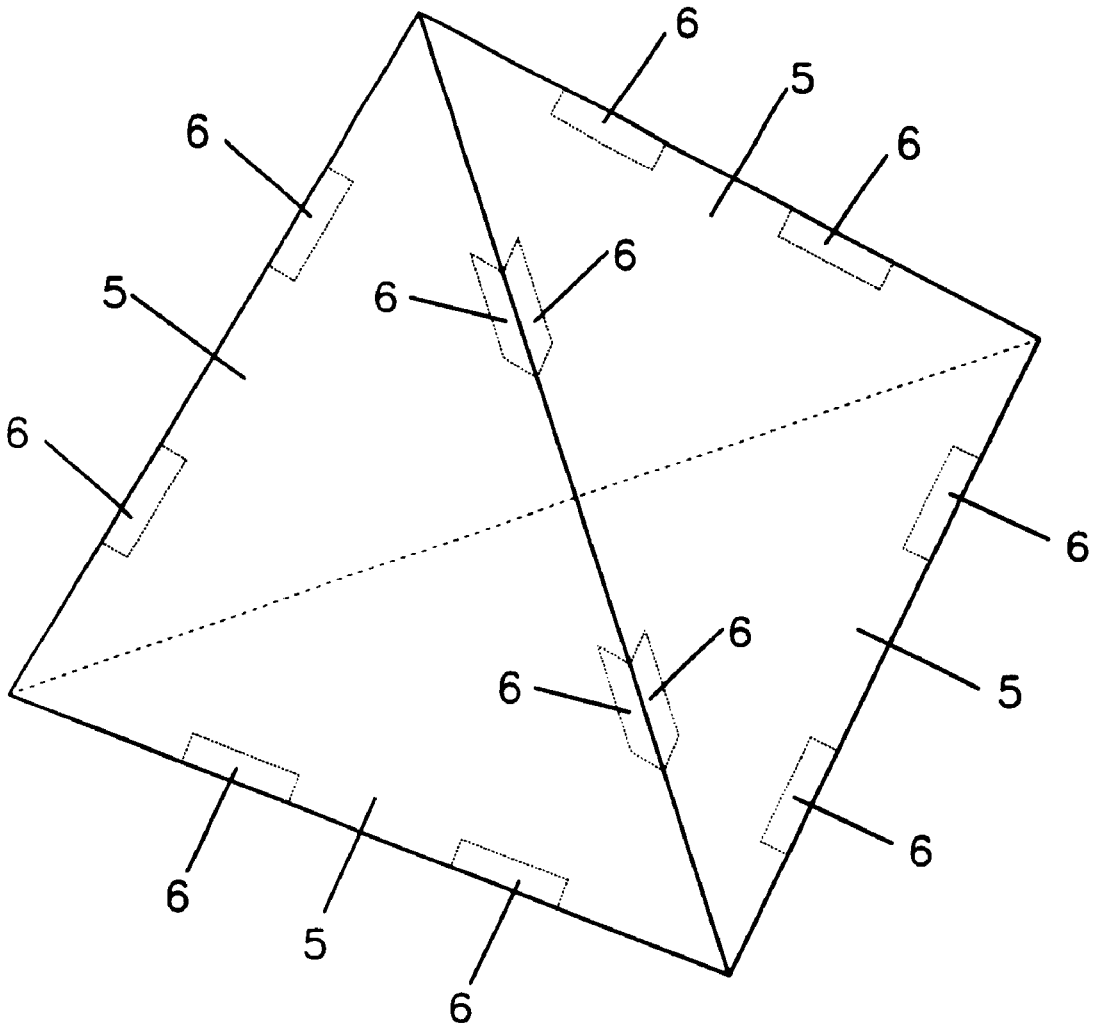
FIG. 4 is a perspective view showing a state in which a solid figure is built from the state as shown in FIG. 3.

FIGS. 3 and 4 are the figures showing the block-building states of a plurality of blocks for use in the present invention. In other words, the figures illustrate a forming process in which the developed plane of tetrahedron is formed into the solid of the triangular pyramid. Four triangles 5 are attracted to each other. In this case, because the anisotropy of a magnet 6 provided on each board 5 is effected secondly in the direction of the arrow X, the boards are easily attracted to each other. While, when the boards 5 are built on the steel blackboard, each board 5 is strongly attracted to the steel blackboard because the anisotropy of the magnet 6 is effected in the vertical direction. Then, as shown in FIG. 4, a solid figure is formed by turning up each board 5 and causing two other sides to be attracted to each other. In this case, an attraction force is effected between the magnets corresponding to respective sides, in addition, an resultant force of magnets is effected, so that it is not possible that the solid figure goes to pieces.

The present invention relates to a toy applied to the building blocks for a preschool child user, and the toy can produce an effect on learning of the relations between the plane and the solid through a play.

Figure 5:
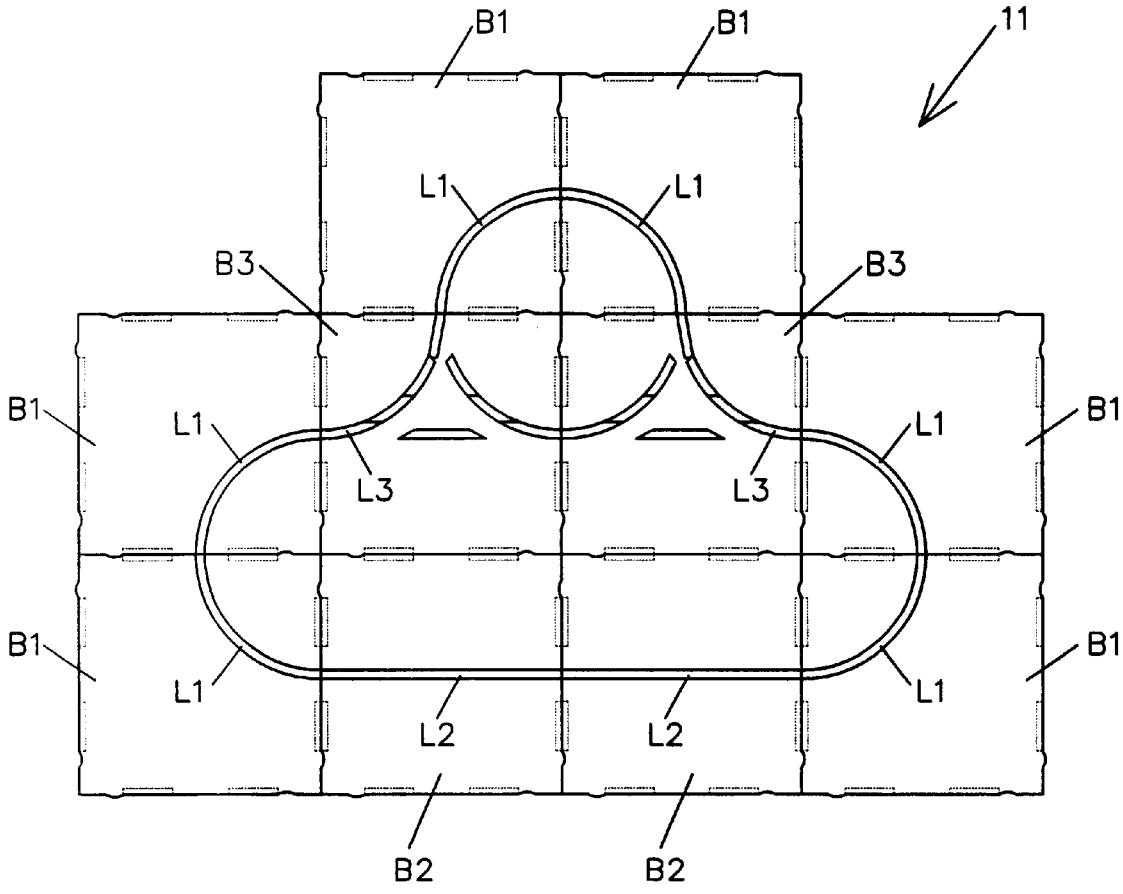
FIG. 5 is a plan view showing a track formed by causing a plurality of blocks for use in the present invention to be attracted.

Next, another embodiment of the present invention will be described in detail. FIG. 5 is a plan view showing a state in which a plurality of blocks for use in the present invention are attracted so as to form a track. A track building toy 11 is constructed by connecting a plurality of track blocks B1, B2 and B3 in combinatorial fashions, wherein the track portions L1, L2 and L3 having different patterns are formed on a surface of said respective track blocks. Each of a plurality of track blocks are constructed in the same manner except that the shapes of the track portions L1, L2 and L3 formed on the surface thereof are different.

Figure 6:
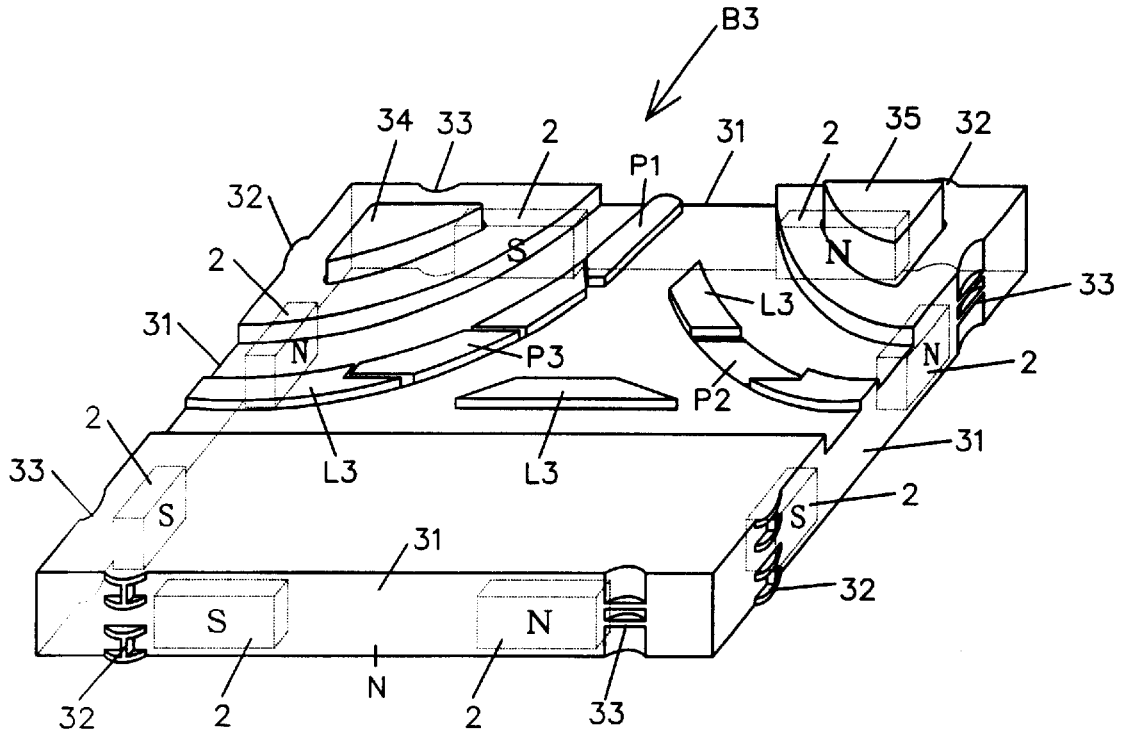
FIG. 6 is a perspective view showing a block forming a transfer point for use in the present invention.
Figure 7:
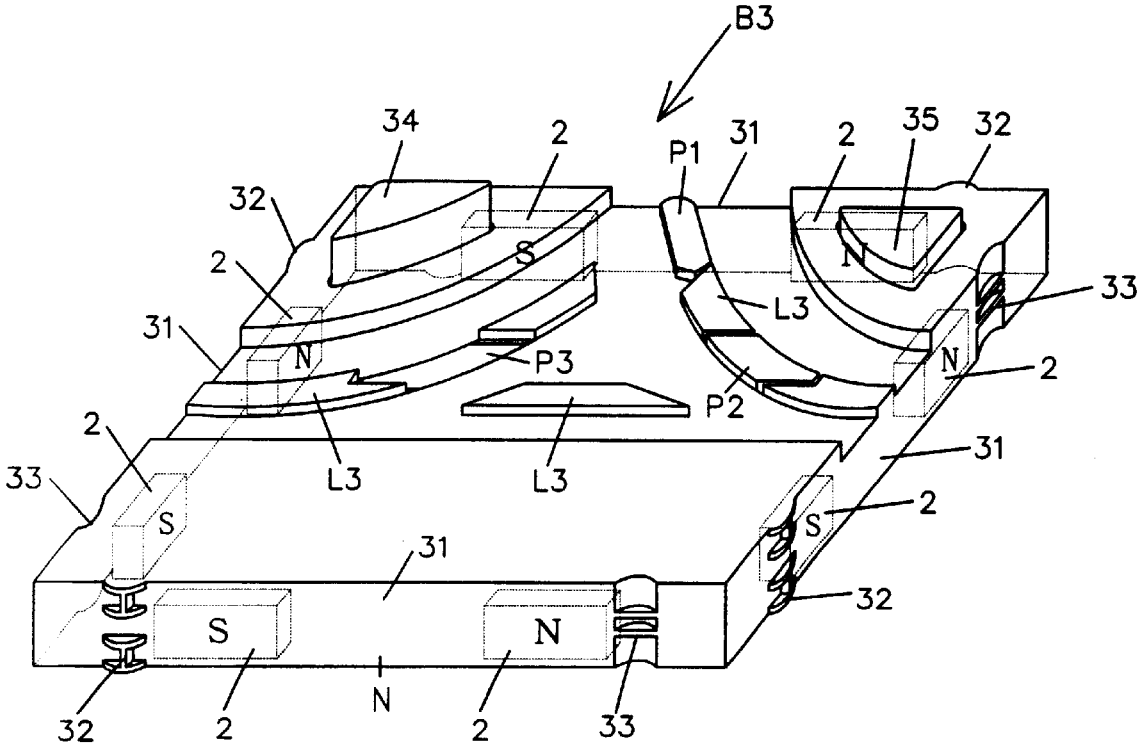
FIG. 7 is a perspective view showing a block forming the transfer point for use in the present invention.

Then, referring to FIGS. 6 and 7, the structure of track block B3 out of a plurality of track blocks B1, B2 and B3 which construct the track building toy will be described in detail. Both figures are the perspective views showing the track block which forms a transfer point for use in the present invention, and the track block B3 is formed into the square being about 20 mm in thickness and made of a hard or soft resin of non-magnetic material, wherein the track portion L3 which forms a part of track is formed on the surface thereof. A pair of male and female u-shaped fitting portions 32 and 33 are formed on each four side 31 of the track block B3 on left-and right-hand sides of the intermediate point N at same intervals, wherein said male and female fitting portions 32 and 33 are designed to be fitted to another male and female fitting portions 32 and 33 formed on each four side of the other blocks in the same manner as the track block B3, and when the sides 31 are connected to each other which are designed to be connected to each other, the male and female fitting portions 32 and 33 thereof are fitted to each other and the fitting portions can so guide the sides 31 that they may not slip out of place in a lateral direction. Furthermore, a pair of permanent magnets 2 are built in each side 31 of block B3, wherein each magnet is disposed on left-and right-hand sides of the intermediate point N at the same intervals, wherein the magnetic polarities thereof, namely, the N pole and the S pole are so arranged that the S and N poles are alternatively faced to the outside of the side 31. In this way, by arranging a pair of permanent magnets 2 on each four side 31 of the block B3, the N pole of permanent magnet of one block is opposite to the S pole of the other, so that two blocks can be connected by being attracted to each other on any of sides 31.

There are the track portions L1, L2 and L3 of different track patterns formed on a plurality of track blocks B1, B2 and B3 so as to form a connecting track L having no end which is adapted to various shapes. That is, as shown in FIG. 5, the track portion L1 in the shape of a quarter arc is formed on the track block B1, the track portion L2 in the shape of a straight line is formed on the track block B2 and the track portion L3 having the transfer point is formed on the track block B3. With said plurality of blocks, by bringing one side near the other, which are opposite to each other, the sides can be connected by being attracted to each other by attraction force of permanent magnets 2 in which the N pole is opposite to the S pole, and, at that time, the male and female fitting portions of each side are fitted to each other and said fitting portions can so guide the sides 31 that they may not slip out of place.

Next, referring to FIGS. 6 and 7, a transfer construction of track block B3 having the transfer point will be described in detail. The transfer construction is designed to work by pressing down a transfer button disposed on the surface of the track block. FIG. 6 illustrates a state in which the left transfer button 34 is pressed down, and, at this time, since the track portion L3 is flat, a toy car coming into the track portion from the left side of the track block B3 does not go straight but takes a curve leftward. And then, as shown in FIG. 7, when the right transfer button 35 is pressed down by a player, one transfer point P1 is moved to the right track portion, and, at the same time, another transfer point P2 is raised. In consequence, since the track portion L3 comes to be flat, the toy car coming track portion from the back of the track block B3 takes a curve leftward. At this time, the third transfer point P3 out of the track portions at the left side is recessed, with the right transfer button being pressed down. Thus, the player can run the toy car coming into the track portion in the arbitrary direction by working the transfer buttons 34 and 35 as the player likes.

And then, as shown in FIG. 5, the connecting track L having no end can be formed so as to run the toy car by connecting a plurality of track blocks having the track portions of various shapes by causing them to be attracted to each other in a continuous fashion. Furthermore, the connecting track L of various patterns can be formed by rearranging the combination of said plurality of track blocks connected by being attracted to each other, so that the toy enables the preschool child to develop his intellectual powers.

In addition, if a plurality of track blocks having the track portions of the shapes different from said track portions L1, L2 and L3 are prepared, the connected track of more various patterns can be formed by rearranging the combination.

The present invention is constructed in the modes described heretofore and provides the following advantages.

The present invention provides a building toy, wherein the magnets are built in each side of the block in a manner such that magnetic polarity thereof is opposite to neighboring magnets, so that the arbitrary sides can be connected by being attracted to each other without repulsion. Therefore, this toy enables the player to combine the blocks easily even if the player is a child who is not able to fit the raised portion to the recessed portion because the function of his fingers is developing. Moreover, the combination of the blocks can be easily rearranged, so that the building toy is very useful for developing the child's intellectual powers and training.

I claim:

1. A building toy comprising a plurality of blocks having faces, connective means for connecting the blocks in which at least two or more permanent magnets are arranged on each side of said blocks in a manner such that a magnetic polarity thereof is opposite to neighboring magnets, and a track portion formed on an upper surface of said blocks, and wherein said blocks are constructed in a manner such that faces of adjacent blocks are attracted, and wherein an arbitrary track on which a running toy can run can be built by causing said plurality of blocks to be attracted so as to connect said track portions.

2. A building toy as set forth in claim 1, wherein said permanent magnets are arranged in a symmetric fashion in a direction parallel to each face such that the N poles and the S poles of the magnets are at approximately constant intervals.

3. A building toy as set forth in claim 1, wherein a raised portion and a recessed portion are formed on each face of said blocks so that said blocks may not slip out of place in a lateral direction when faces of adjacent blocks are caused to be attracted.

4. A building toy as set forth in claim 1, wherein there are a plurality of patterns of track portions formed on surfaces of said blocks, and the arbitrary track can be built by causing a plurality of blocks to be attracted to each other.

* * * * *